United States Patent [19]

Knoblauch et al.

[11] 4,371,448

[45] Feb. 1, 1983

[54] HYDRAULIC FLUID COMPOSITION WITH IMPROVED PROPERTIES BASED ON BORIC ACID ESTERS, GLYCOL MONO-ETHERS AND BIS-(GLYCOLETHER) FORMALS

[75] Inventors: Wolfgang Knoblauch, Burghausen; Konrad von Werner, Burgkirchen, both of Fed. Rep. of Germany

[73] Assignee: Hoechst Aktiengesellschaft, Fed. Rep. of Germany

[21] Appl. No.: 204,326

[22] Filed: Nov. 5, 1980

[30] Foreign Application Priority Data

Nov. 8, 1979 [DE] Fed. Rep. of Germany ..... 2945094

[51] Int. Cl.[3] ..... C10M 3/48

[52] U.S. Cl. ..... 252/78.1; 252/74; 252/75; 252/76; 252/77; 252/78.5; 252/79

[58] Field of Search ..... 252/73, 74, 75, 76, 252/77, 78.1, 78.5, 79

[56] References Cited

U.S. PATENT DOCUMENTS 3,625,899 12/1971 Sawyer et al. ..... 252/75
3,711,411 1/1973 Sawyer et al. ..... 252/78
3,779,930 12/1973 Alcorn ..... 252/77
3,972,822 8/1976 Sato et al. ..... 252/78.1
4,088,590 5/1978 Knoblauch et al. ..... 252/73
4,116,846 9/1978 Sato et al. .
4,173,542 11/1979 Sata et al. ..... 252/78.1
4,219,434 8/1980 Ellis ..... 252/78.1

FOREIGN PATENT DOCUMENTS 2438038 2/1975 Fed. Rep. of Germany .

*Primary Examiner*—P. E. Willis, Jr.
*Attorney, Agent, or Firm*—Connolly and Hutz

[57] ABSTRACT

A hydraulic fluid which substantially fulfils the specification DOT 5 is described. This hydraulic fluid essentially consists of (A) about 20 to 40% by weight of at least one boric acid ester obtained from orthoboric acid, diethylene glycol and an ethylene glycol monoalkyl ether; (B) 30 to 60% by weight of at least one ethylene glycol monoalkyl ether; (C) 10 to 40% by weight of at least one bis-(ethylene glycol monoalkyl ether)-formal; (D) 0.1 to 5% by weight of at least one alkylamine; and (E) 0.05 to 5% by weight of at least one stabilizer and/or inhibitor; the percentages by weight in each case being relative to the total weight of the fluid.

8 Claims, No Drawings

HYDRAULIC FLUID COMPOSITION WITH IMPROVED PROPERTIES BASED ON BORIC ACID ESTERS, GLYCOL MONO-ETHERS AND BIS-(GLYCOLETHER) FORMALS

The invention relates to a hydraulic fluid based on certain boric acid esters and bis-(ethylene glycol monoalkyl ether)-formals.

Stringent requirements are made of hydraulic fluids, in particular of brake fluids, with regard to their chemical and physical properties. According to the standards at present in existence (compare the specifications of the U.S. Department of Transportation in Federal Motor Vehicle Safety Standard=FMVSS No. 116 and Specifications SAE J 1703 of the Society of Automotive Engineers, New York), brake fluids should have, in particular, the following basic properties: a high dry boiling point (reflux boiling point when dry) and wet boiling point (reflux boiling point when moist) and a viscosity which changes only slightly within a wide temperature range.

The values required for these parameters for a DOT 3 and DOT 4 brake fluid are summarized below:

| | FMVSS No. 116 | |
|---|---|---|
| | DOT 3 | DOT 4 |
| Dry boiling point (°C.) | min. 205 | min. 230 |
| Wet boiling point (°C.) | min. 140 | min. 155 |
| Viscosity at −40° C. ($mm^2/s$) | max. 1500 | max. 1800 |
| Viscosity at 100° C. ($mm^2/s$) | min. 1.5 | min. 1.5 |

In addition to these primary properties, a brake fluid should also have a number of other properties. Amongst these properties, in addition to a high stability to heat and chemicals, above all the compatibility of the brake fluid with polymers, in particular with natural and synthetic rubber, and their evaporation loss after carrying out the corresponding SAE test are important.

Hydraulic fluids, in particular brake fluids which are based on boric acid esters of glycols and/or glycol monoalkyl ethers and which contain, as further main components, glycol monoalkyl ethers, glycol dialkyl ethers, polyglycols and/or bis-(glycol ether)-formals are already known (compare German patent specification No. 929,045, German Auslegeschriften Nos. 1,768,933 and 2,457,097 and German Offenlegungsschriften Nos. 2,141,441, 2,257,546, 2,437,936, 2,438,038, 2,525,403, 2,532,228, 2,724,193 and 2,804,535).

However, these known brake fluids still leave something to be desired. The reason for this is, above all, that amongst the requirements which a brake fluid should fulfil there are also those which are conflicting because of the chemical and physical properties of the main components. Thus, for example, it is known to be very difficult to adjust the viscosity of a brake fluid based on boric acid esters in accordance with the DOT-4 standard and at the same time also to achieve a boiling point and/or compatibility with rubber which corresponds to the standard. When formulating known brake fluids based on boric acid esters, a gain in an important property is thus frequently bought by a relatively high sacrifice in another important property.

Further, there has recently been an increasing tendency to place more stringent requirements than hitherto on the performance of brake fluids in order to ensure an even higher traffic safety and also to achieve a longer useful life. This is manifested by the more stringent specification DOT-5 (compare the summary below):

| | FMVSS No. 116 DOT-5 |
|---|---|
| Dry boiling point (°C.) | min. 260 |
| Wet boiling point (°C.) | min. 180 |
| Viscosity at −40° C. ($mm^2/s$) | max. 900 |
| Viscosity at 100° C. ($mm^2/s$) | min. 1.5 |

A brake fluid which, especially with the basic properties mentioned above, exhibits particularly excellent values with respect to its behavior towards polymers and in the abovementioned evaporation test would thus be desirable.

The object of the invention is accordingly to provide a hydraulic fluid, in particular a brake fluid, which not only entirely fulfils the pattern of properties according to the standard demanded at present but also fulfils the abovementioned extended requirements.

The hydraulic fluid according to the invention essentially consists of (A) 20 to 40% by weight, relative to the weight of the total fluid, of a boric acid ester which is obtained when orthoboric acid ($H_3BO_3$), diethylene glycol ($HOCH_2CH_2OCH_2CH_2OH$) and an ethylene glycol monoalkyl ether of the formula I $$R(OCH_2CH_2)_xOH \qquad (I)$$

in which R is an alkyl group with 1 to 4 C atoms and x is an integer from 2 to 4, are reacted in a molar ratio of 1:1:1, (B) 30 to 60% by weight, relative to the weight of the total fluid, of at least one ethylene glycol monoalkyl ether of the formula I in which R and x have the meaning given;

(C) 10 to 40% by weight, relative to the weight of the total fluid, of at least one bis-(ethylene glycol monoalkyl ether)-formal of the formula II $$R^1(OCH_2CH_2)_{n1}O—CH_2—O(CH_2CH_2O)_{n2}R^2 \qquad (II)$$

wherein $R^1$ and $R^2$ denote an alkyl group with 1 to 4 C atoms and $n_1$ and $n_2$ denote an integer from 1 to 4;

(D) 0.1 to 5% by weight, relative to the weight of the total fluid, of at least one alkylamine of the formula III

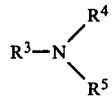

(III)

in which $R^3$ denotes an alkyl or monounsaturated alkenyl group with 1 to 18 C atoms, $R^4$ denotes hydrogen, $—(CH_2CH_2O)_yH$ or

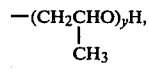

in which y is an integer from 1 to 5, and $R^5$ denotes hydrogen, $—(CH_2CH_2O)_yH$ or $$-(CH_2\underset{\underset{CH_3}{|}}{C}HO)_yH,$$

in which y is an integer from 1 to 5, or an alkyl or monounsaturated alkenyl group with 1 to 18 C atoms, with the proviso that the sum of the C atoms in $R^3$ and $R^5$ in formula III is not greater than 18; and (E) 0.05 to 5% by weight, relative to the weight of the total fluid, of at least one stabilizer and/or inhibitor.

The boric acid esters according to component (A)—a reaction product of orthoboric acid, diethylene glycol and an ethylene glycol monoalkyl ether of the formula I in a molar ratio of 1:1:1—are prepared by procedures which are known per se. The reactants mentioned are reacted in a reaction vessel, provided with a stirrer and if appropriate with a reflux condenser, at a temperature of about 50° to about 150° C., preferably about 110° to about 140° C., whilst stirring, the water of reaction formed being removed continuously. The reaction can be carried out in the presence of an inert solvent which forms an azeotrope with water, such as, for example, benzene, toluene, xylene, ethylbenzene or the like. The water of reaction can also be removed by carrying out the reaction under reduced pressure, for example under a waterpump vacuum (7 to 20 mbars). When the reaction has ended (that is to say after the theoretical amount of water liberated has been collected), the solvent which may have been used is removed from the reaction product by customary distillation and this product—if further purification should still be necessary—is appropriately vacuum-stripped at a temperature of 90° to 150° C.

The product thus obtained is component (A) of the hydraulic fluid according to the invention. Amongst the ethylene glycol monoalkyl ethers of the formula I which are employed for the preparation of the boric acid esters, those in which R is a straight-chain alkyl group with 1 to 4 C atoms, preferably $CH_3$ or $C_2H_5$, and x is 3, are preferred.

The reaction product of orthoboric acid, diethylene glycol and ethylene glycol monoalkyl ether of the formula I in a molar ratio of 1:1:1 probably consists of a mixture of boric acid esters of different formulae in various proportions by weight. It can be assumed that the boric acid ester of the formula below represents the main constituent of this mixture:

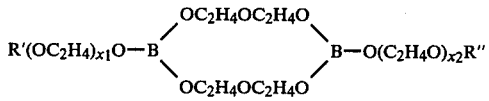

in which R', R'', $x_1$ and $x_2$ have one of the meanings of R and x in formula I (preferably, R'=R'' and $x_1=x_2$).

Those ethylene glycol monoalkyl ethers of the formula I in which R is a straight-chain alkyl group with 1 to 4 C atoms, preferably $CH_3$ or $C_2H_5$, and x is 3, are preferred as component (B) of the hydraulic fluid according to the invention.

Methyl-triethylene glycol $CH_3(OC_2H_4)_3OH$ is particularly preferred.

Those bis-(ethylene glycol monoalkyl ether)-formals of the formula II in which $R^1$ and $R^2$ are straight-chain alkyl groups with 1 to 4 C atoms, preferably $CH_3$ or $C_2H_5$, and $n_1$ and $n_2$ are 2 or 3, and wherein, preferably, $R^1=R^2$ and $n_1=n_2$, are preferred as component (C) of the hydraulic fluid according to the invention.

Component (D) of the hydraulic fluid according to the invention consists of the alkylamines of the formula III. Examples of the radicals $R^3$ and $R^5$ (which can be straight-chain or branched) which may be mentioned are: methyl, ethyl, propyl, isopropyl, butyl, iso-butyl, pentyl, hexyl, octyl (capryl), nonyl, isononyl, dodecyl (lauryl), palmityl, stearyl and oleyl. The alkyl or alkenyl group ($R^3$, $R^5$) preferably contains 1 to 9 C atoms. The sum of the C atoms in $R^3$ and $R^5$ is preferably not greater than 10. y in formula III preferably denotes an integer from 1 to 3.

Those alkylamines of the formula III wherein $R^3$ is an alkyl group with 1 to 9 C atoms and $R^4$ and $R^5$ are hydrogen or $-(CH_2CH_2O)_yH$, in which y is an integer from 1 to 5, preferably 1 to 3, are preferred.

Those alkylamines of the formula III in which $R^3$ is propyl, butyl, hexyl, octyl or isononyl and $R^4$ and $R^5$ are identical and denote hydrogen or $CH_2CH_2OH$ are particularly preferred as component (D).

Component (E) of the hydraulic fluid according to the invention consists of customary additives for fluids based on boric acid esters and glycol derivatives.

These additives include stabilizers, for example pH-stabilizers, and inhibitors, for example inhibitors of corrosion and oxidation (antioxidants).

Suitable pH-stabilizers which are preferred are those from the group comprising inorganic alkali metal salts, preferably the sodium salts of carbonic acid, phosphorous acid or phosphoric acid; alkali metal salts of fatty acids, preferably the sodium salt of lauric acid, palmitic acid, stearic acid or oleic acid; trialkanolamines, preferably triethanolamine; and trialkylamines (tert.-amines), for example dimethylcaprylamine and diethylcaprylamine. The pH-stabilizers are preferably employed in an amount of 0.1 to 4% by weight, relative to the total weight of fluid.

Amongst the suitable corrosion inhibitors, the following are preferably employed: fatty acids, preferably caprylic acid, lauric acid, palmitic acid, stearic acid or oleic acid; esters of phosphorous acid or phosphoric acid with aliphatic alcohols with 1 to 6 C atoms, preferably ethyl phosphate, dimethyl phosphate, isopropyl phosphate, diisopropyl phosphate, butyl phosphite and dimethyl phosphite; and/or triazoles, preferably benztriazole.

The corrosion inhibitors are preferably employed in an amount of 0.05 to 1% by weight, relative to the weight of the total fluid.

Amongst the suitable antioxidants, the following compounds, individually or as mixtures with one another, are preferred: aromatic amines, preferably phenyl-α-naphthylamine, diphenylamine and derivatives thereof; substituted phenols, preferably dibutylcresol, 2,6-dibutyl-p-cresol, 2,6-di-tert.-butyl-p-cresol and 2,4-dimethyl-6-tert.-butylphenol; pyrocatechol and hydroquinone, optionally nuclear-substituted; quinones, preferably anthraquinone; and phenothiazines, which can also be nuclear-substituted.

The antioxidants are preferably employed in an amount of 0.05 to 1% by weight, relative to the weight of the total fluid.

The hydraulic fluid according to the invention preferably essentially consists of (A) 25 to 35% by weight;
(B) 35 to 58% by weight;
(C) 15 to 32% by weight;

(D) 0.2 to 4% by weight; and (E) 0.2 to 4% by weight, the percentages by weight in each case being relative to the weight of the total fluid.

The hydraulic fluid according to the invention is prepared by mixing together the components, for example in a tank with a stirring organ, whereby a homogeneous mixture is obtained in a simple manner. As a rule, the components are mixed together under atmospheric pressure and at room temperature, but, if appropriate, mixing can also be carried out at elevated temperature (30° to 50° C.), it being expedient to exclude moisture.

The hydraulic fluids according to the invention are suitable, above all, for hydraulic braking systems, preferably for motor vehicles, for hydraulic steering systems and for hydraulic transmissions.

The invention is illustrated in still more detail by the following examples.

EXAMPLES 1 TO 4

The following boric acid esters ($A_1$ to $A_4$) to be used according to the invention are prepared by reacting orthoboric acid, diethylene glycol and an ethylene glycol monoalkyl ether of the formula I. The reaction is in each case carried out by a procedure in which the three reactants, in a molar ratio of 1:1:1, are kept in a reaction vessel at a temperature of about 120° C. under a water-pump vacuum, whilst stirring, until about the theoretical amount of water has been collected.

The reaction product thus obtained is one of the boric acid esters $A_1$ to $A_4$;

boric acid ester $A_1$ is a reaction product of orthoboric acid, diethylene glycol and triethylene glycol monomethyl ether (methyl-triethylene glycol);

boric acid ester $A_2$ is a reaction product of orthoboric acid, diethylene glycol and diethylene glycol monomethyl ether;

boric acid ester $A_3$ is a reaction product of orthoboric acid, diethylene glycol and triethylene glycol monoethyl ether;

boric acid ester $A_4$ is a reaction product of orthoboric acid, diethylene glycol and diethylene glycol monobutyl ether.

EXAMPLE 5

A brake fluid according to the invention is produced by mixing the following components:

| | % by weight |
|---|---|
| Component A: | |
| Boric acid ester $A_1$ | 30.3 |
| Component B: | |
| Triethylene glycol monomethyl ether | 36.0 |
| Component C: | |
| Bis-(diethylene glycol monomethyl ether)-formal | 30.8 |
| Component D: | |
| Butyldiethanolamine | 2.6 |
| Component E: | |
| Benztriazole | 0.1 |
| Diphenylamine | 0.2 |

EXAMPLE 6

A brake fluid according to the invention is produced by mixing the following components:

| | % by weight |
|---|---|
| Component A: | |
| Boric acid ester $A_2$ | 26.8 |
| Component B: | |
| Triethylene glycol monomethyl ether | 45.0 |
| Component C: | |
| Bis-(diethylene glycol monomethyl ether)-formal | 27.5 |
| Component D: | |
| Caprylamine | 0.5 |
| Component E: | |
| Benztriazole | 0.1 |
| Phenyl-α-naphthylamine | 0.1 |

EXAMPLE 7

A brake fluid according to the invention is produced by mixing the following components:

| | % by weight |
|---|---|
| Component A: | |
| Boric acid ester $A_3$ | 28.3 |
| Component B: | |
| Triethylene glycol monoethyl ether | 52.8 |
| Component C: | |
| Bis-(diethylene glycol monomethyl ether)-formal | 15.0 |
| Component D: | |
| Capryldiethanolamine | 3.7 |
| Component E: | |
| Isopropyl phosphate | 0.1 |
| Phenothiazine | 0.1 |

EXAMPLE 8

A brake fluid according to the invention is produced by mixing the following components:

| | % by weight |
|---|---|
| Component A: | |
| Boric acid ester $A_4$ | 31.0 |
| Component B: | |
| Triethylene glycol monomethyl ether | 40.6 |
| Tetraethylene glycol monomethyl ether | 17.0 |
| Component C: | |
| Bis-(diethylene glycol monomethyl ether)-formal | 11.0 |
| Component D: | |
| Butylamine | 0.3 |
| Component E: | |
| 2,6-Dibutylcresol | 0.1 |

EXAMPLE 9

A brake fluid according to the invention is produced by mixing the following components:

| | % by weight |
|---|---|
| Component A: | |
| Boric acid ester $A_1$ | 31.7 |
| Component B: | |
| Diethylene glycol monobutyl ether | 16.0 |
| Triethylene glycol monomethyl ether | 20.0 |
| Component C: | |
| Bis-(triethylene glycol monomethyl ether)-formal | 31.0 |
| Component D: | |
| Isononylamine | 1.0 |
| Component E: | |
| Benztriazole | 0.1 |

-continued

| | % by weight |
|---|---|
| Diphenylamine | 0.2 |

EXAMPLE 10

A brake fluid according to the invention is produced by mixing the following components:

| | % by weight |
|---|---|
| Component A: | |
| Boric acid ester $A_2$ | 33.2 |
| Component B: | |
| Triethylene glycol monomethyl ether | 55.2 |
| Component C: | |
| Bis-(triethylene glycol monobutyl ether)-formal | 10.5 |
| Component D: | |
| Butylamine | 0.8 |
| Component E: | |
| Phenyl-α-naphthylamine | 0.2 |
| Benztriazole | 0.1 |

The hydraulic fluids, according to the invention, of Examples 5 to 10 have been tested in accordance with the methods of FMVSS No. 116 and SAE. The results are summarized in the following Tables 1 and 2.

Example 5 (see Table 1) has been tested fully, in accordance with the specifications mentioned. Only the basic properties and the swelling properties and evaporation loss of the brake fluids according to Examples 6 to 10 were tested, since the values required for the other properties (which, as is known, are considerably easier to achieve than the values required for the basic properties) would hardly differ from those of the brake fluid of Example 5.

TABLE 1

| Testing in accordance with FMVSS No. 116 | Result for Example 5 |
|---|---|
| Boiling point (ERBP) | 274° C. |
| Wet boiling point (wet ERBP) | 181° C. |
| Kinematic viscosity at 100° C. | 2.2 $mm^2/s$ |
| Kinematic viscosity at −40° C. | 860 $mm^2/s$ |
| pH value before/after corrosion | 7.8/7.6 |
| Stability at elevated temperature | −2° C. |
| Chemical stability | −1.5° C. |
| Corrosion (change in weight in $mg/cm^2$): | |
| tinned iron | ±0 |
| steel | ±0 |
| aluminum | ±0 |
| cast iron | +0.06 |
| brass | −0.02 |
| copper | −0.01 |
| Low-temperature properties at −40° C.: | |
| appearance | clear, no formation of layers |
| rising time of bubbles | 1 s |
| at −50° C.: | |
| appearance | clear, no formation of layers |
| rising time of bubbles | 3 s |
| Evaporation: | |
| weight loss | 55% by weight |
| pour point of the residue | −40° C. |
| Water tolerance at −40° C.: | |
| appearance | clear, no formation of layers |
| rising time of bubbles | 1 s |
| at 60° C.: | |
| appearance | clear, no formation of layers |

TABLE 1-continued

| Testing in accordance with FMVSS No. 116 | Result for Example 5 |
|---|---|
| Oxidation resistance (weight loss in $mg/cm^2$): | |
| aluminum | ±0 |
| cast iron | −0.01 |
| Swelling of rubber (SBR) (change in the diameter of the bottom in mm at 120° C. for 70 hours) | +1.06 |
| Stroking test | passed |

TABLE 2

| Testing in accordance with FMVSS No. 116 | Results for Examples 6 | 7 | 8 | 9 | 10 |
|---|---|---|---|---|---|
| Boiling point (°C.) | 261 | 257 | 260 | 266 | 258 |
| Wet boiling point (°C.) | 185 | 178 | 183 | 182 | 187 |
| Kinematic viscosity ($mm^2/s$) at −40° C. | 920 | 1010 | 976 | 880 | 1025 |
| at 100° C. | 2.3 | 2.1 | 2.2 | 2.2 | 2.2 |
| Swelling of rubber (SBR) 70 hours, 120° C. Change in the diameter of the bottom (mm) | +1.02 | +0.95 | +0.87 | +1.30 | +0.72 |
| Evaporation Weight loss (% by weight) | 78 | 73 | 72 | 61 | 58 |

We claim:

1. Hydraulic fluid essentially consisting of (A) 20 to 40% by weight, relative to the weight of the total fluid, of a boric acid ester which is obtained when orthoboric acid, diethylene glycol and an ethylene glycol monoalkyl ether of the formula I $$R(OCH_2CH_2)_xOH \quad (I)$$

in which R is an alkyl group with 1 to 4 C atoms and x is an integer from 2 to 4, are reacted in a molar ratio of 1:1:1 at a temperature of 50° to 150° C., the water of reaction formed being removed continuously;

(B) 30 to 60% by weight, relative to the weight of the total fluid, of at least one ethylene glycol monoalkyl ether of the formula I in which R and x have the meaning given;

(C) 10 to 40% by weight, relative to the weight of the total fluid, of at least one bis-(ethylene glycol monoalkyl ether)-formal of the formula II $$R^1(OCH_2CH_2)_{n_1}O—CH_2—O(CH_2CH_2O)_{n_2}R^2 \quad (II)$$

wherein $R^1$ and $R^2$ denote an alkyl group with 1 to 4 C atoms and $n_1$ and $n_2$ denote an integer from 1 to 4;

(D) 0.1 to 5% by weight, relative to the weight of the total fluid, of at least one alkylamine of the formula III

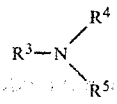

(III)

in which $R^3$ denotes an alkyl or monounsaturated alkenyl group with 1 to 18 C atoms, $R^4$ denotes hydrogen, $-(CH_2CH_2O)_yH$ or $$-(CH_2\underset{\underset{CH_3}{|}}{C}HO)_yH,$$

in which y is an integer from 1 to 5, and $R^5$ denotes hydrogen, $-(CH_2CH_2O)_yH$ or $$-(CH_2\underset{\underset{CH_3}{|}}{C}HO)_yH,$$

in which y is an integer from 1 to 5, or an alkyl or monounsaturated alkenyl group with 1 to 18 C atoms, with the proviso that the sum of the C atoms in $R^3$ and $R^5$ in formula III is not greater than 18; and (E) 0.05 to 5% by weight, relative to the weight of the total fluid, of at least one ingredient selected from the group consisting of a pH stabilizer, a corrosion inhibitor, and an antioxidant.

2. Hydraulic fluid as claimed in claim 1, in which components (A) to (E) are present in the following amounts:

(A) 25 to 35% by weight;
(B) 35 to 58% by weight;
(C) 15 to 32% by weight;
(D) 0.2 to 4% by weight; and
(E) 0.2 to 4% by weight.

3. Hydraulic fluid as claimed in claim 1, in which component (A) is a reaction product of orthoboric acid, diethylene glycol and methyl- or ethyl-triethylene glycol in a molar ratio of 1:1:1; component (B) is methyl- or ethyl-triethylene glycol; component (C) is a bis-(di- or tri-ethylene glycol monomethyl or monoethyl ether)-formal; component (D) is an alkylamine of the formula III in which $R^3$ is an alkyl group with 1 to 9 C atoms and $R^4$ and $R^5$ are hydrogen or $-(CH_2CH_2O)_yH$, in which y is an integer from 1 to 5; and component (E) comprises a pH stabilizer selected from inorganic alkali metal salts, alkali metal salts of fatty acids, trialkanolamines, and trialkylamines and mixtures thereof; a corrosion inhibitor selected from fatty acids, esters of phosphorus acid or phosphoric acid with $C_1$–$C_6$ aliphatic alcohols, triazoles, and mixtures thereof; or an antioxidant selected from aromatic amines, substituted phenols, pyrocatechol, hydroquinones, quinones, and mixtures thereof.

4. Hydraulic fluid as claimed in claim 1, wherein the pH stabilizer of component (E) is selected from the group consisting of inorganic alkali metal salts, alkali metal salts of fatty acids, trialkanolamines, and trialkylamines and mixtures thereof.

5. Hydraulic fluid as claimed in claim 1, in which the corrosion inhibitor of component (E) is selected from the group consisting of fatty acids, esters of phosphorous acid or phosphoric acid with $C_1$–$C_6$ aliphatic alcohols, triazoles, and mixtures thereof.

6. Hydraulic fluid as claimed in claim 1, in which the antioxidant of said component (E) is selected from the group consisting of aromatic amines, substituted phenols, pyrocatechol, hydroquinones, quinones, and mixtures thereof.

7. Hydraulic fluid as claimed in claim 1, in which component (D) is selected from the group consisting of a $C_1$–$C_{18}$ alkylamine and a $C_1$–$C_9$ alkyl diethanolamine.

8. Hydraulic fluid as claimed in claim 1, in component (A) comprises a boric acid ester of the formula

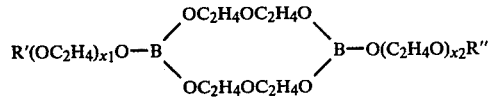

in which R' and R'' are the same or different and and are alkyl groups with 1 to 4 C atoms, and $x_1$ and $x_2$ are the same or different and are integers from 2 to 4.

* * * * *